US007514878B2

(12) United States Patent
Crandall et al.

(10) Patent No.: US 7,514,878 B2
(45) Date of Patent: Apr. 7, 2009

(54) HIGH FREQUENCY ELECTRONIC BALLAST WITH SINE WAVE OSCILLATOR

(75) Inventors: Earl F. Crandall, Raleigh, NC (US); Robert C. Smallwood, Sr., Englewood, CO (US)

(73) Assignee: PureSpectrum, Inc., Savannah, GA (US)

( * ) Notice: Subject to any disclaimer, the term of this patent is extended or adjusted under 35 U.S.C. 154(b) by 0 days.

(21) Appl. No.: 10/817,707

(22) Filed: Apr. 2, 2004

(65) Prior Publication Data

US 2005/0104537 A1 May 19, 2005

Related U.S. Application Data

(60) Provisional application No. 60/460,381, filed on Apr. 4, 2003.

(51) Int. Cl.
*H05B 37/02* (2006.01)

(52) U.S. Cl. ..... 315/224; 315/225; 315/209 R; 315/276; 315/307

(58) Field of Classification Search ..... 315/209 R, 315/224–226, 244, 276, 291, 307, 312, DIG. 7
See application file for complete search history.

(56) References Cited

U.S. PATENT DOCUMENTS 3,681,654 A 8/1972 Quinn ..... 315/291
3,943,471 A 3/1976 Ryan
4,187,450 A 2/1980 Chen
4,277,726 A * 7/1981 Burke ..... 315/98
4,395,659 A * 7/1983 Aoike et al. ..... 315/209 R
4,513,224 A 4/1985 Thomas
4,575,668 A * 3/1986 Baker ..... 318/811
4,700,111 A 10/1987 Folwell et al.
4,992,702 A * 2/1991 Shimizu et al. ..... 315/219
5,023,519 A * 6/1991 Jensen ..... 315/242
5,097,182 A * 3/1992 Kelly ..... 315/219
5,150,013 A 9/1992 Bobel ..... 315/307
5,173,643 A 12/1992 Sullivan et al.
5,500,792 A * 3/1996 Jeon et al. ..... 363/98
5,559,405 A * 9/1996 Notohamiprodjo ..... 315/209 R (Continued)

FOREIGN PATENT DOCUMENTS

WO 03/019992 A1 3/2003

(Continued)

OTHER PUBLICATIONS

Wells, E., "Using the UC3871 and UC3872 Resonant Fluorescent Lamp Drivers in Floating Lamp Applications" Unitrode Design Note, DN-75, May 1997, pp. 1-4.

(Continued)

*Primary Examiner*—Douglas W Owens
*Assistant Examiner*—Jimmy T Vu
(74) *Attorney, Agent, or Firm*—Alston & Bird LLP

(57) ABSTRACT

A high frequency sinusoidal wave is generated and applied directly to a gas discharge lamp in a power efficient electronic ballast. Uniting a high frequency current fed oscillator with a transformer, where direct current may be applied to the center tap of the transformer primary winding to enable the impression of a sinusoidal alternating current at the secondary winding. This sinusoidal alternating current is applied directly to a gas discharge lamp. Feedback from the transformer controls the switching of the oscillator at resonant frequency.

5 Claims, 4 Drawing Sheets

U.S. PATENT DOCUMENTS

| | | | | |
|---|---|---|---|---|
| 5,615,093 | A | 3/1997 | Nalbant | 315/291 |
| 6,005,355 | A * | 12/1999 | Siao | 315/277 |
| 6,046,548 | A * | 4/2000 | Kominami et al. | 315/246 |
| 6,087,781 | A | 7/2000 | Leppelmeier | |
| 6,091,206 | A * | 7/2000 | Siao | 315/219 |
| 6,114,814 | A * | 9/2000 | Shannon et al. | 315/219 |
| 6,114,816 | A | 9/2000 | Nuckolls et al. | |
| 6,370,039 | B1 | 4/2002 | Telefus | |
| 6,445,599 | B1 | 9/2002 | Nguyen | |
| 6,577,066 | B1 | 6/2003 | Kominami et al. | |
| 6,710,551 | B2 * | 3/2004 | Mita et al. | 315/209 R |
| 6,765,808 | B1 | 7/2004 | Jin et al. | |
| 6,813,170 | B2 | 11/2004 | Yang | |
| 6,814,462 | B1 | 11/2004 | Fiene | |
| 6,815,906 | B1 | 11/2004 | Aarons et al. | |
| 6,900,599 | B2 | 5/2005 | Ribarich | |
| 6,963,176 | B2 | 11/2005 | Onishi et al. | |
| 7,061,188 | B1 * | 6/2006 | Katyl et al. | 315/291 |
| 7,235,932 | B2 | 6/2007 | Crandall et al. | |
| 7,388,334 | B2 | 6/2008 | Crandall et al. | |
| 2002/0021093 | A1 | 2/2002 | Kakisaka et al. | |

FOREIGN PATENT DOCUMENTS

| | | | |
|---|---|---|---|
| WO | WO 03/019992 | A1 | 3/2003 |

OTHER PUBLICATIONS

Lin, Mu-Shen et al., "Primary-Side Dimming Control Driver for Cold-Cathode Fluorescent Lamps", Electronic Letters, IEEE Stevenage, GB., vol. 32, No. 15, Jul. 18, 1996, pp. 1334-1335.

Lin, Mu-Shen, et al., "A Cold-Cathode Fluorescent Lamp Driver Circuit with Synchronous Primary-Side Dimming Control" IEEE Transactions on Industrial Electronics, IEEE Inc, New York, US, vol. 45, No. 2, Apr. 1, 1998, pp. 249-255.

* cited by examiner

HIGH FREQUENCY ELECTRONIC BALLAST WITH SINE WAVE OSCILLATOR

RELATED APPLICATIONS

This application claims priority under 35 U.S.C §119 to provisional patent application Ser. No. 60/460,381 filed on Apr. 4, 2003, entitled "High Efficiency Electronic Ballast with Sine Wave Oscillator," which is incorporated by reference herein in its entirety.

BACKGROUND

The present invention relates generally to electronic ballasts for gas discharge lamps. More specifically, this invention relates to the production of a high efficiency electronic ballast by unifying power and lamp control at a high, resonant frequency of alternating current applied directly to fluorescent lamps.

Fluorescent light operates by creating a discharge or arc across an ionized gas within a glass tube. In traditional fluorescent lighting, the gas tube is filled with mercury vapor which, when ionized, can collide with electrons of a current flow across the electrodes of a lamp, and emit photons. These photons strike fluorescent material on the inner wall of the glass tube and produce visible light.

Fluorescent lamps require a ballast to operate. The ballast conditions the electric power to produce the input characteristics needed for the lamp. When arcing, the lamp exhibits a negative resistance characteristic, and therefore needs some control to avoid a cascading discharge. Both manufacturers and the American National Standards Institute specify lamp characteristics, which include current, voltage, and starting conditions. Historically, 50-60 Hz ballasts relied on a heavy core of magnetic material; today, most modern ballasts are electronic.

Electronic ballasts can include a starting circuit and may or may not require heating of the lamp electrodes for starting or igniting the lamp. Prior to ignition, a lamp acts as an open circuit; when an arc is created the lamp starts, the entire ballast starting voltage is applied to the lamp. After ignition, the current through the lamp increases until the lamp voltage reaches equilibrium based on the ballast circuit. Ballasts can also have additional circuitry designed to filter electromagnetic interference (EMI), correct power factor errors for alternating current power sources, filter noise, etc.

Electronic ballasts typically use a rectifier and an oscillating circuit to create a pulsed flow of electricity to the lamp. Common electronic lighting ballasts convert 60 Hz line or input current into a direct current, and then back to a square wave alternating current to operate lamps near frequencies of 20-40 kHz. Some lighting ballasts further convert the square wave to more of a sine wave, typically through an LC resonant lamp network to smooth out the pulses to create sinusoidal waveforms for the lamp. See, for example, U.S. Pat. No. 3,681,654 to Quinn, or U.S. Pat. No. 5,615,093 to Nalbant.

The square wave approach is common for a number of reasons. Many discrete or saturated switches are better suited to the production of a square wave than a sinusoidal wave. In lower frequency applications, a square wave provides more consistent lighting; a normal sinusoid at low frequency risks de-ionization of the gas as the voltage cycles below the discharge level. A square wave provides a number of other features, such as constant instantaneous lamp power, and favorable crest factors. With a square wave, current density in the lamp is generally stable, promoting long lamp life; similarly, there is little temperature fluctuation, which avoids flicker and discharge, damaging the lamp.

It is known that higher frequencies can produce more efficient lighting. In general, if de-ionization is minimized or avoided, then less energy is needed because there is no re-ionization of the gas; that is, a higher frequency avoids the cycle of decay and recovery of ionization within the lamp. Further, the anode fall voltage can be lower when the frequency is higher than the oscillation frequency of the plasma.

However, higher frequency ballasts suffer some problems. First, electronic ballasts can create harmonic disturbance, due in part to the use of pulses or square wave signals. Harmonics are signals in which the frequency is a whole number multiple of the system's fundamental frequency; the third harmonic is most damaging. The total harmonic distortion (or "THD") is one measure of ballast performance. Harmonics create unexpected or nonlinear loading of circuit elements; the harmonic signals cause voltage drops at points of impedance, at the frequency of the harmonic current. At high frequency, the circuitry required to convert a square wave into a sinusoidal wave may limit the available frequency of operation; high frequency voltage drops can change the voltage values of the fundamental wave. A ballast with a high THD may also create electromagnetic interference with nearby electrical equipment, necessitating additional circuitry to filter harmonics; however, such circuits can introduce additional problems such as high inrush current. Second, as discussed in U.S. Pat. No. 5,173,643 to Sullivan, it is generally believed that operating frequencies above 50 KHz may introduce other adverse aspects with respect to the circuit's capacitance.

Finally, the semiconductor switches of many oscillating circuits in electronic ballasts have faced inefficiency or losses, including thermal dissipation, at high frequency driving. Thus, ballast technology has heretofore been limited, thereby also limiting the opportunity for improved energy efficiency.

SUMMARY

It should be emphasized that the terms "comprises" and "comprising", when used in this description and claims, are taken to specify the presence of stated features, steps, or components, but the use of these terms does not preclude the presence or addition of one or more other features, steps, components, or groups thereof.

In one aspect, a unified electronic ballast for a gas discharge lamp, includes a first circuit adapted to produce a sinusoidal alternating current at a voltage approximately equal to the strike voltage of said gas discharge lamp, the first circuit including an oscillator having a plurality of transistors and adapted to create the sinusoidal alternating current at the fundamental frequency of the first circuit, and a second circuit adapted to receive and apply the sinusoidal alternating current to the gas discharge lamp, the second circuit comprising a center tapped transformer having a feedback winding for controlling the transistors of the oscillator; at least one capacitor positioned in parallel to at least one of the windings of said transformer.

In another aspect, a method is disclosed for driving a gas discharge lamp from a unified electronic ballast, that includes oscillating a signal at a circuit's fundamental frequency using a pair of transistors to produce a sinusoidal alternating current, and a voltage approximately equal to the strike voltage of said gas discharge lamp. The alternating current is applied to the gas discharge lamp. A signal proportional to the alternating current is fed back, the feedback signal being applied to each transistor of the oscillator to control the oscillated signal frequency. A capacitor between the transistors of the oscillator charges and discharges with said feedback signal.

BRIEF DESCRIPTION OF THE DRAWINGS

Objects and advantages of the present invention will become apparent to those skilled in the art upon reading this description in conjunction with the accompanying drawings, in which like reference numerals have been used to designate like elements, and in which.

DETAILED DESCRIPTION

For the purposes of this specification and the appended claims, the terms "connected" or "joined" mean that there exists a conductive path, which may include elements that are not explicitly recited.

Figure 1:
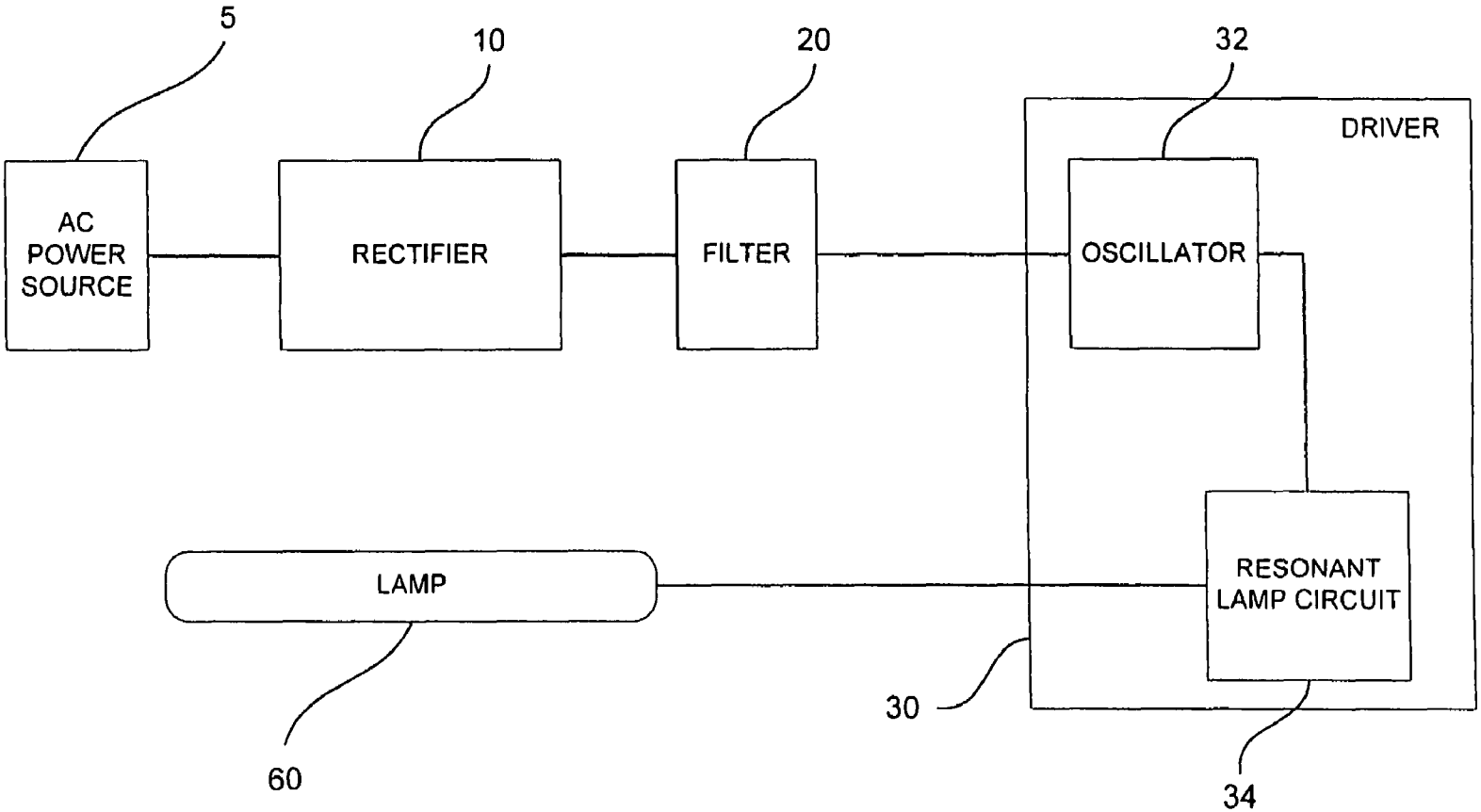
FIGURE 1 (PRIOR ART)
FIG. 1 shows a block diagram of a typical prior art electronic ballast.

FIG. 1 shows a basic block diagram of the conventional approach to electronic ballast design; a rectifier 10 converts an alternating current from an AC power source 5 into direct current, which is passed through a filter 20 to a lamp driver 30 comprising an oscillator 32 and a resonant lamp circuit 34. The oscillator 32 generates a square wave at a frequency from 20 to 40 KHz. The lamp circuit 34 is required to condition the square wave for a lamp 60; this conditioning includes treatment of the wave as described above, such as filtering harmonic distortion and noise.

Figure 2:
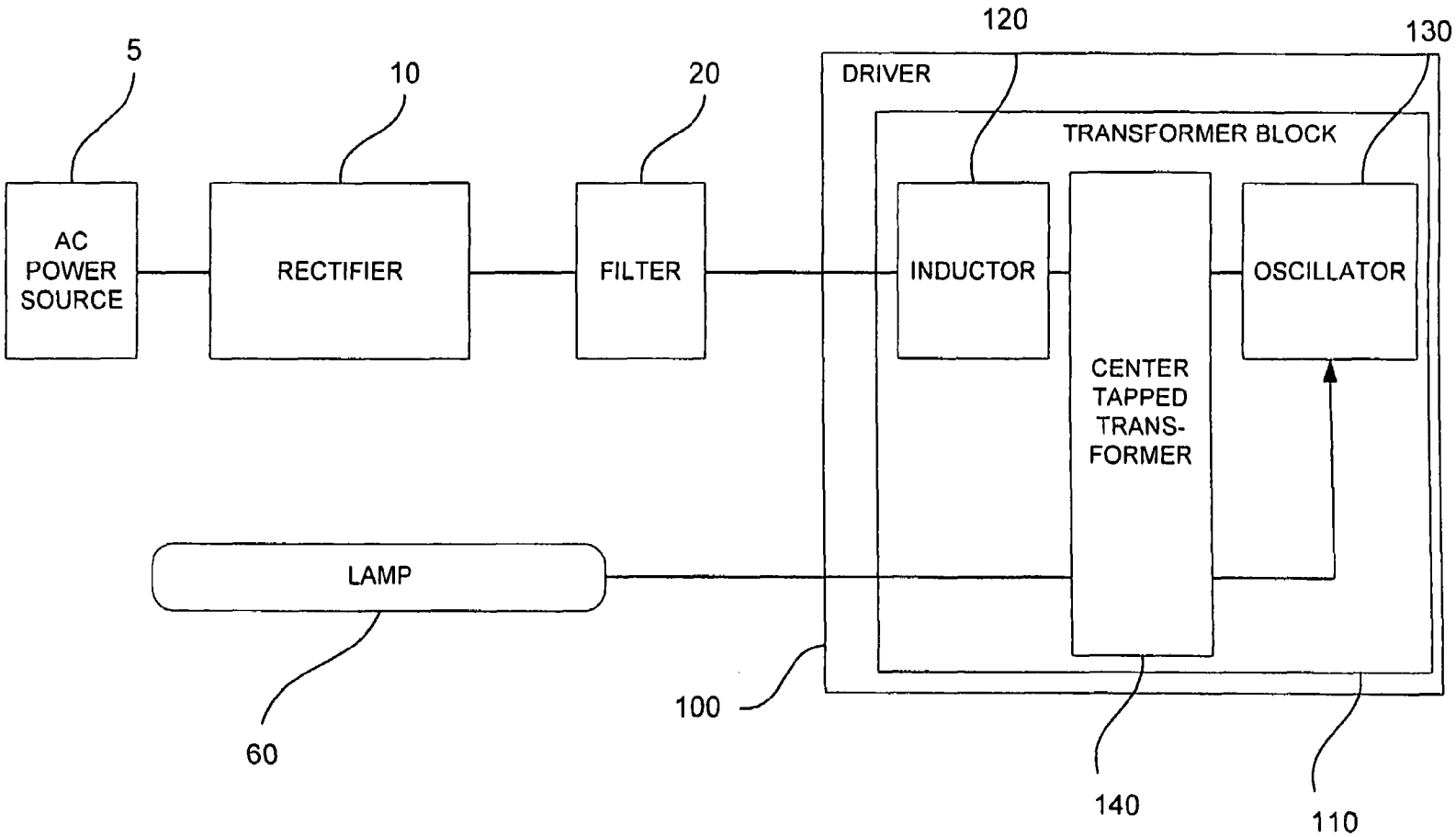
FIG. 2 shows a block diagram of an embodiment of the invention adapted for receiving an alternating current input.
Figure 3:
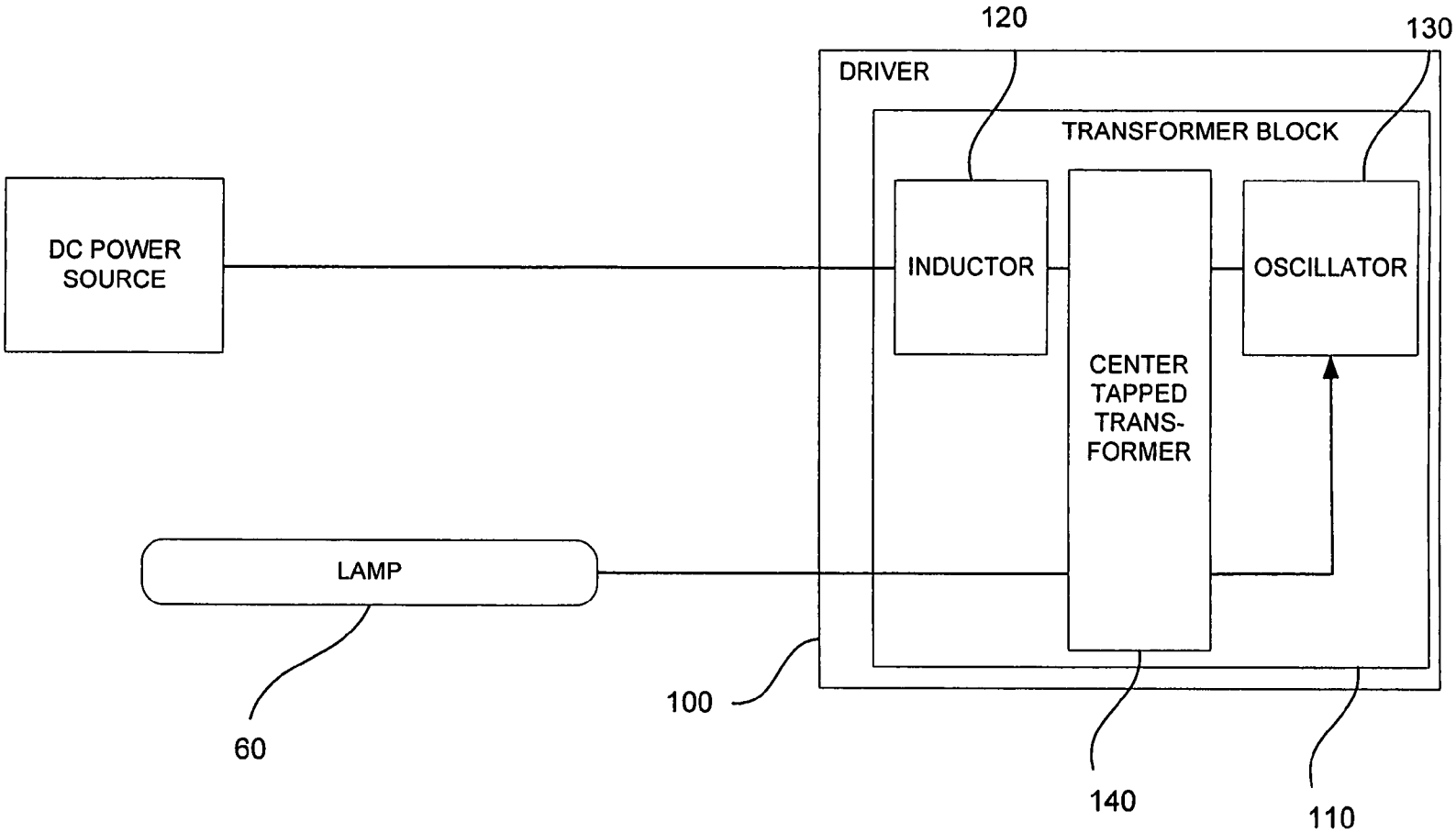
FIG. 3 shows a block diagram of an embodiment of the invention adapted for receiving a direct current input.

FIG. 2 is a basic block diagram of a lamp system incorporating an embodiment of the present invention adapted to receive an alternating current input. This design applies a fundamental, higher frequency, sinusoidal alternating current directly to the lamp 60 using a unified approach. As shown, a rectifier 10 converts the alternating current input from the AC power source 5 into a direct current, which may then be passed through a filter to remove any alternating current ripple. The filter 20 may be any suitable L-C or Pi filter or the equivalent. It should be noted that the invention is not limited to alternating current sources of input power; the rectifier 10 and filter 20 may be omitted for applications involving a direct current input, as illustrated in FIG. 3.

The filtered current is then provided to a lamp driver 100, which comprises a current limiting inductance 120, a center tapped transformer 140, and an oscillator 130. The current limiting inductance 120 receives the filtered direct current and applies it to the center tapped transformer 140. The oscillator 130, in conjunction with the center tapped transformer 140, converts the filtered direct current into a high frequency alternating current across the primary of the transformer 140. Feedback from the transformer 140 is tuned by resonant capacitance, so that the oscillator 130 operates at the fundamental frequency of the circuit.

Figure 4:
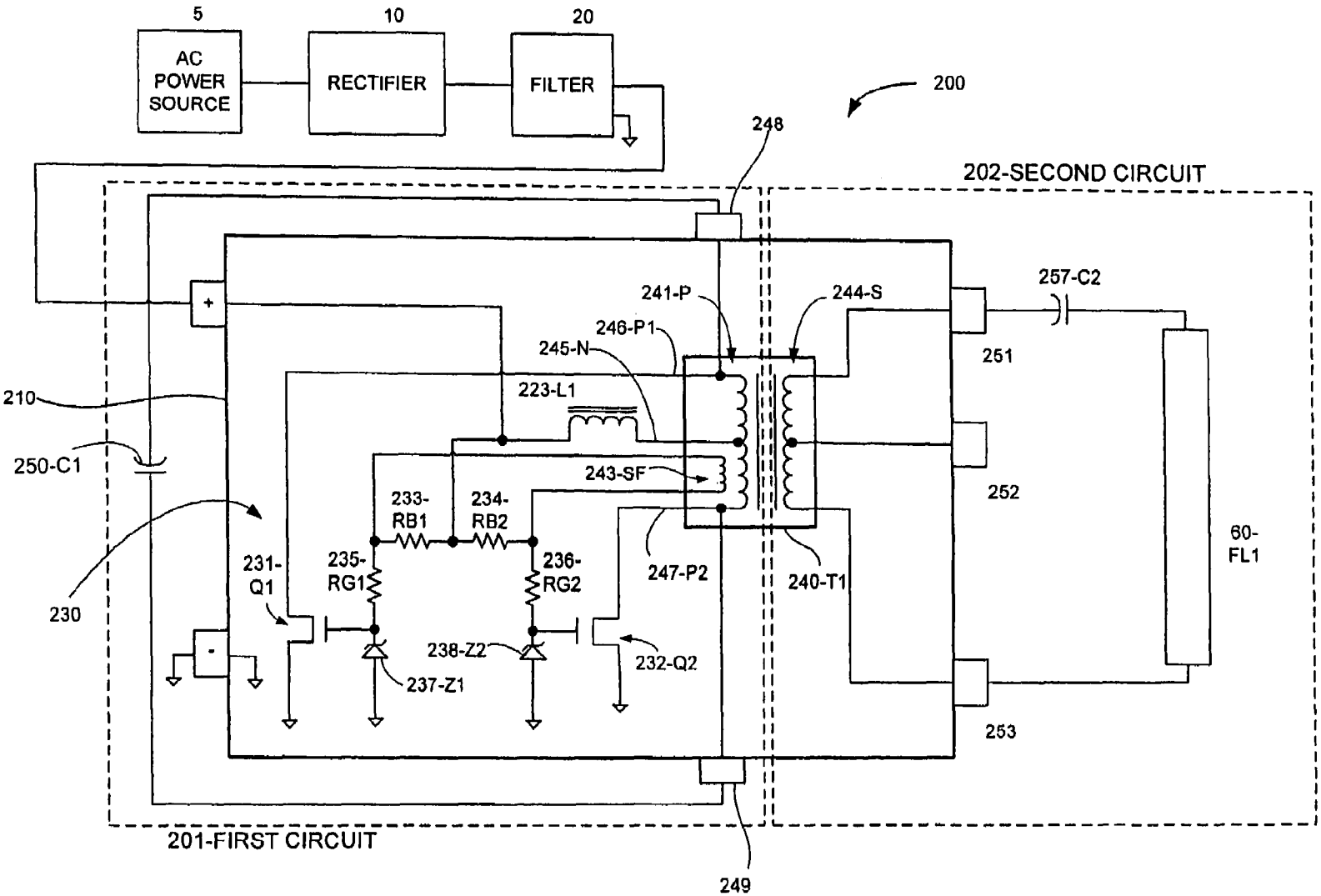
FIG. 4 shows a schematic of an embodiment of the invention.

FIG. 4 shows a wiring diagram of a high frequency driver 200 according to an embodiment of the invention. As before, the alternating current power source 5 provides an alternating current that is converted to a direct current by rectifier 10, which may be one of any number of designs known in the art and capable of producing a direct current from an alternating current. A clean direct current that is free from any line or alternating current ripple is desired for embodiments with alternating current input in order to maintain the purity of the oscillator resonant frequency. Any ripple frequency energy could modulate the gas discharge lamp, and reduce efficiency. Accordingly, filter 20 is typically located after rectifier 10.

Filter 20 can employ any of a variety of filter designs well known in the art and is therefore not shown in detail. In addition, those skilled in the art will recognize that with a direct current power supply or input, rectifier 10 and filter 20 may be omitted, as shown in FIG. 3, or replaced with a single diode or other such components appropriate for that direct current input.

The high frequency driver 200 comprises a transformer block 210 and a resonance capacitor 250-CI. A transformer block 210 includes a center tapped transformer 240-T1, a current limiting inductor or choke 223-L1 and an oscillator portion 230. Inductor 223-L1 receives the filtered direct current, and acts to limit current change. As discussed below, inductor 223-L1 plays a role in setting the voltage ultimately applied to lamp 60. The output of inductor 223-L1 is applied to center tap 245-N of primary winding 241-P of transformer 240-T1; that is, center tap 245-N splits the primary winding 241-P of transformer 240-T1 into a first portion 246-P1 and a second portion 247-P2.

The first and second primary portions 246-P1 and 247-P2 are connected to the oscillator 230. The oscillator 230 includes first and second transistors 231-Q1 and 232-Q2, which are joined drain-to-drain, with the junction occurring across primary winding 241-P of transformer 240-T1. That is, each end of primary winding 241-P connects to a drain of one of transistors 231-Q1 and 232-Q2. Although field effect transistors (FET) are shown, transistors 231-Q1 and 232-02 may alternatively be bipolar or other equivalents. Resistors 235 and 236 serve to limit the current into the gates of transistors 231 and 232 and into Zener diodes 237 and 238. Zener diodes 237 and 238 serve to limit the voltage that is impressed on the gates of 231 and 232. Resistors 233 and 234 provide bias for starting. Zener diodes 237 and 238 also serve to prevent excessive negative voltage on the gates of transistors 231 and 232.

The primary winding 241-P of the transformer 240-T1, the inductor 223-L1 and the oscillator 230 combine to form a first circuit 201. Secondary winding 244-S, which is coupled to primary winding 241-P, is positioned in series with the gas discharge lamp 60-FL1, which is connected to first and second output ports 251, 253. In some embodiments, it may be desirable to drive the lamp 60 using only one side of the secondary winding 244-S. In such instances, the lamp 60 may be connected to the center tap output 252 and either of the first and second output ports 251, 253. It is desirable to introduce some capacitance in series with lamp 60-FL1 and secondary winding 244-S in order to offer some ballast and provide direct current blocking for lamp 60-FL1. This capacitance is represented by capacitor 257-C2, but could also include alternate configurations of circuit design available to create a capacitance in the absence of a discrete, separate component, as is known in the art. By way of example and not limitation, such configurations may include alternatives such as placing two conductors near each other without touching.

Thus, capacitor 257-C2 is in series with secondary winding 244-S and lamp 60-FL1, thereby forming a second circuit 202. This design may include other circuitry as desired for the particular application; for example, the system may include one or more heaters, which are generally omitted for use with cold cathode fluorescent lamps.

The no load voltage impressed on the secondary winding 244-S of transformer 240-T1 is preferably approximately equal to the strike voltage of lamp 60-FL1. The alternating current output voltage of oscillator 230 at transformer 240-T1 is a linear function of the voltage at inductor 223-L1. Those skilled in the art will readily see how components of a variety of values could achieve this objective.

The transformer block 210 may also include a feedback winding 243-SF that may be coupled either to primary winding 241-P or secondary winding 244-S. Those skilled in the art will recognize that this feedback may be provided in a variety of ways to achieve a similar effect, possibly even arranged by a separate transformer. In the illustrated embodiment, the gates of transistors 231-Q1 and 232-Q2 are joined across feedback winding 243-SF, with the resonance capacitor 250-CI in parallel with the feedback winding 243-SF. The resonance capacitor 250-CI may be connected to the transformer block at a first connection point 248 connected to the first primary portion 246-P1 and a second connection point 249 connected to the second primary portion 247-P2. The resonance capacitor 250-CI may alternatively be located in parallel with primary winding 241-P, secondary winding 244-S, or a combination thereof.

Resistors 235 and 236 serve to limit the current into the gates of transistors 231 and 232 and into zener diodes 237 and 238. Zener diodes 237 and 238 serve to limit the voltage that is impressed on the gates of 231 and 232. Resistors 233 and 234 provide bias for starting. Zener Diodes 237 and 238 also serve to prevent excessive negative voltage on the gates of transistors 231 and 232.

In some embodiments, a power conversion stage may be included with a basic Royer circuit in order to regulate lamp power from line voltage changes.

In operation, the electronic ballast described above is designed to produce a more efficient conversion of input energy into light than has been achieved in conventional ballasts. By applying a sinusoidal alternating current to the lamp at high frequency, preferably between 100 KHz to 250 KHz, the ballast prevents de-ionization and improves efficiency. A unified approach to the generation and application of a sinusoidal wave eliminates the two step creation of a discrete square wave that must then treated by an L-C or other circuit to render it more sinusoidal. Such a two step approach is vulnerable to harmonic distortion, electromagnetic interference, and noise. The generation of a pure sine wave is better suited for gas discharge lamps and is significantly less vulnerable to harmonic distortion, electromagnetic interference, and noise. Although the present invention is operable with lamps of a variety of sizes, the use of physically smaller lamps, e.g., T1 through T3 (those of a diameter of ⅛ to ⅜ inches), demonstrated better lighting performance than in larger lamps. The use of tri- or quad-phosphor lamps will further increase light output bandwidth within the visible frequency spectrum.

With reference again to FIG. 4, a current-fed oscillator may be employed to convert a direct current into a sinusoidal alternating current for driving a lamp. A direct current is applied to inductor 223-L1. The oscillation is formed when transistors 231-Q1 and 232-Q2 alternatively switch, conducting against the impedance of inductor 223-L1, into center tap 245-N, and across the respective portions of primary winding 241-P to form a sinusoidal alternating current. The voltage of the alternating current is a linear function of the voltage at inductor 223-L1, determining the wave amplitude. A base signal for transistors 231-Q1 and 232-Q2 is provided by feedback winding 243-SF, which is timed by parallel capacitor 250-C1. Selection of the values of the individual components of the unified electronic ballast should preferably produce a no load voltage for the alternating current equal to the strike voltage of lamp 60-FL1. An induced sinusoidal alternating current is produced in secondary winding 244-S by its coupling with primary 241-P. The current at lamp 60-FL1 is ballasted by a small capacitance, as provided, for example, by a high-voltage capacitor 257-C2 positioned in series with lamp 60-FL1. Capacitor 257-C2 may also perform direct current blocking to resist lamp mercury migration.

In general, the operating frequency of an oscillator is determined by the resonant frequency of the tank circuit formed by the capacitive and inductive components, and the load that is coupled across the output, such as transformer 240-T1. In this case the oscillation occurs at the loaded resonant frequency of the network formed by capacitor 250-C1, the magnetizing inductance of primary winding 241-P, and the reflected impedance of the output load at secondary winding 244-S (lamp, capacitor 257-C2, and any stray capacitance). Capacitor 250-C1 may be placed across, (i.e., in parallel with) any winding or combination of windings of transformer 240-T1 to achieve the desired effect. Preferably this oscillator operates at a frequency between 100 KHz and 250 KHz.

The sinusoidal shape of the alternating current is dependent upon the quality factor or "Q value" of the loaded circuit. The loaded Q value is preferably greater than 3 to ensure stable operation; a value between 6 and 12 may be typical. Another aspect of the relatively high Q factor is that a large amount of energy circulates within the circuit relative to the amount of power delivered to the gas discharge lamp. In a less efficient design at high frequency, this characteristic could cause stray capacitance, losses, noise, and interference, particularly if the lamp requires greater energy. In the preferred embodiment, a relatively high current circulates on the side of primary winding 241-P of transformer 240-T1 at a relatively low voltage, and a lower current circulates on the side of secondary winding 244-S of transformer 240-T1, at a relatively higher voltage. Inasmuch as it is an object of the present invention to reduce power consumption for lighting, the topologies described are well suited to operation at lower power levels. For example, the present invention has shown the ability to provide 100 Watts of effective lighting for 15 Watts of power in a hot cathode lamp and 7.5 Watts of power in a cold cathode lamp.

Table 1 below shows the results based on Lumens, which is a candle-based standard. This test, originally developed by Thomas A. Edison, is currently obsolete. The output provided by a fluorescent lamp driven by the described ballast as measured using a candle-based test, which basically measures yellow light, is less than that of typical ballast driving a fluorescent lamp. Measurement equipment and capabilities, however, have changed, as has bulb technology. Modern light sources with light output that match normal daylight or normal sunlight are more efficient, healthier, and more desirable, and provide better visibility.

| Lamp Type | Present Invention w/DC power source | Typical CFL |
|---|---|---|
| Watts | 14.6 | 18.6 |
| Lumen Output | 922.4 | 1325 |
| Lumens/Watt | 63 | 71 |

The Commission Internationale de l'Eclairage ("CIE") standards allow for the measurement of light to several standards including the A standard, and $D_{65}$ standard.

The Lumen however is tied to the A standard only. Applicants developed the $Blumen_{65}$ standard, which based on the "Blumens," (Blue Lumens) for the measurement of full spectrum light, and is more closely tied to the $D_{65}$ standard. According to the CIE Standard Colorimetric Illuminants, two illuminants are used in colorimetry. CIE Standard Illuminant A is intended to represent typical, domestic, tungsten-filament lighting. Its relative spectral power distribution is that of a Planckian radiator at a temperature of approximately 2 856 K CIE Standard Illuminant A should be used in all applications of colorimetry involving the use of incandescent lighting, unless there are specific reasons for using a different illuminant.

CIE Standard Illuminant $D_{65}$ is intended to represent average daylight and has a correlated color temperature of approximately 6 500 K CIE Standard Illuminant D65 should be used in all calorimetric calculations requiring representative daylight, unless there are specific reasons for using a different illuminant. Variations in the relative spectral power distribution of daylight are known to occur, particularly in the ultraviolet spectral region, as a function of season, time of day, and geographic location. However, CIE Standard Illuminant $D_{65}$ should be used pending the availability of additional information on these variations (see *CIE Draft Standard DS* 005.2/E-1996).

Certified lab tests were designed by the Illuminating Engineering Society of North America and conducted by a member of the National Voluntary Laboratory Accreditation Program (NVLAP) that specializes in energy-efficient lighting products. Here, such a test was performed in which performance with regard to efficacy and light output was judged for a compact florescent light typically sold on the market and a compact florescent light driven by the ballast of the present invention. The results of this experiment are shown in Table 2.

| Lamp Type | Present Invention | Present Invention w/ DC source | Typical CFL |
|---|---|---|---|
| Watts | 11.8 | 14.6 | 18.6 |
| Blumen Output | 3520 | 9150 | 1325 |
| Blumens/Watt | 298 | 640 | 71 |

$Blumens_{65}$ is the same as Lumens but measured using the $D_{65}$ CIE Standard. $Blumens_{55}$ is the same as Lumens but measured using the $D_{55}$ CIE Standard. $Blumens_{75}$ is the same as Lumens but measured using the $D_{75}$ CIE Standard.

As shown by the results in Table 2, the present invention produces more than twice the Blumens per watt of current lamps. Accordingly, as the foregoing results show, it is preferable to use the energy efficient arrangement of the present invention.

As shown by the results in Table 1, the present invention produces more than twice the lumens per watt of current lamps. Accordingly, as the foregoing results show, it is preferable to use the energy efficient arrangement of the present invention.

It will be appreciated by those of ordinary skill in the art that the invention can be embodied in various specific forms without departing from its essential characteristics. The disclosed embodiments are considered in all respects to be illustrative and not restrictive. The scope of the invention is indicated by the appended claims, rather than the foregoing description, and all changes that come within the meaning and range of equivalents thereof are intended to be embraced thereby.

What is claimed is:

1. A circuit, comprising:

a power source coupled to a center tap of a primary winding via an inductor, a first end of the primary winding being coupled to a second end of the primary winding via a capacitor;

a first node being coupled to the power source, the first node coupled to both a second node via a first resistor and a third node via a second resistor, the second and third node being coupled via a feedback path;

a first transistor having a gate coupled to the second node via a third resistor, a drain coupled to the first end of the primary winding, and a source being coupled to a reference signal, wherein the gate is coupled to the reference signal via a diode;

a second transistor having a gate coupled to the third node via a fourth resistor, a drain coupled to the second end of the primary winding, and a source being coupled to the reference signal, wherein the gate is coupled to the reference signal via a diode; and a secondary winding having a first end coupled to a first end of a light source via a capacitor and a second end coupled to a second end of the light source.

2. A circuit as defined in claim 1, wherein the feedback path comprises a feedback winding.

3. A circuit as defined in claim 2, wherein the first transistor and the second transistor are to generate a signal having a frequency using the feedback winding.

4. A circuit as defined in claim 3, wherein the signal causes the light source to emit light in response.

5. A circuit as defined in claim 3, wherein the capacitor is to selectively store and discharge energy at the frequency.

* * * * *